US008663137B2

(12) United States Patent
Escudero et al.

(10) Patent No.: US 8,663,137 B2
(45) **Date of Patent: *Mar. 4, 2014**

(54) COMPRESSION BELT SYSTEM FOR USE WITH CHEST COMPRESSION DEVICES

(75) Inventors: Paul Q. Escudero, Redwood City, CA (US); Gregory W. Hall, Redwood City, CA (US)

(73) Assignee: Zoll Circulation, Inc., Sunnyvale, CA (US)

( * ) Notice: Subject to any disclaimer, the term of this patent is extended or adjusted under 35 U.S.C. 154(b) by 377 days.

This patent is subject to a terminal disclaimer.

(21) Appl. No.: 12/961,782

(22) Filed: Dec. 7, 2010

(65) Prior Publication Data

US 2011/0137216 A1 Jun. 9, 2011

Related U.S. Application Data

(63) Continuation of application No. 12/190,214, filed on Aug. 12, 2008, now Pat. No. 7,846,112, which is a continuation of application No. 10/686,185, filed on Oct. 14, 2003, now Pat. No. 7,410,470.

(51) Int. Cl.
*A61H 31/00* (2006.01)

(52) U.S. Cl.
USPC ..... 601/41; 601/44

(58) Field of Classification Search
USPC ..... 601/41–44, 107, 108, 134, 135, 601/143–148, 151, 152, DIG. 6, DIG. 20; 602/13, 32–35, 38
See application file for complete search history.

(56) References Cited

U.S. PATENT DOCUMENTS

| | | | | |
|---|---|---|---|---|
| 5,577,515 | A | 11/1996 | Stout et al. | |
| 7,354,407 | B2 * | 4/2008 | Quintana et al. | 601/41 |
| 7,410,470 | B2 * | 8/2008 | Escudero et al. | 601/41 |
| 7,846,112 | B2 * | 12/2010 | Escudero et al. | 601/41 |
| 2006/0116613 | A1 * | 6/2006 | Halperin et al. | 601/41 |
| 2010/0174216 | A1 * | 7/2010 | Jensen et al. | 601/41 |

* cited by examiner

*Primary Examiner* — Quang D Thanh
(74) *Attorney, Agent, or Firm* — K. David Crockett, Esq.; Paul J. Backofen, Esq.; Crockett & Crockett, PC

(57) ABSTRACT

A compression belt cartridge for use with chest compression devices. The compression belt cartridge has a double-oar shaped belt and a cover plate through which the belt is threaded. The cover plate is provided with hooks and snap latches that fit into a belt drive platform. The cover plate is sized and dimensioned to fit within only selected platforms. The belt attaches to the means for tightening the belt via a spline attached to the belt. The means for tightening a belt then repetitively tightens the belt, thereby accomplishing chest compressions.

2 Claims, 3 Drawing Sheets

COMPRESSION BELT SYSTEM FOR USE WITH CHEST COMPRESSION DEVICES

RELATED APPLICATIONS

This application is a continuation of U.S. Utility patent application Ser. No. 12/190,214 filed Aug. 12, 2008, now U.S. Pat. No. 7,846,112 which is a continuation of U.S. Utility patent application Ser. No. 10/686,185 filed Oct. 14, 2003, now U.S. Pat. No. 7,410,470.

FIELD OF THE INVENTIONS

The inventions described below relate to emergency medical devices and methods and the resuscitation of cardiac arrest patients.

BACKGROUND OF THE INVENTIONS

Cardiopulmonary resuscitation (CPR) is a well-known and valuable method of first aid used to resuscitate people who have suffered from cardiac arrest. CPR requires repetitive chest compressions to squeeze the heart and the thoracic cavity to pump blood through the body. Artificial respiration, such as mouth-to-mouth breathing or a bag mask apparatus, is used to supply air to the lungs. When a first aid provider performs manual chest compression effectively, blood flow in the body is about 25% to 30% of normal blood flow. However, even experienced paramedics cannot maintain adequate chest compressions for more than a few minutes. Hightower, et al., *Decay In Quality Of Chest Compressions Over Time,* 26 Ann. Emerg. Med. 300 (September 1995). Thus, CPR is not often successful at sustaining or reviving the patient. Nevertheless, if chest compressions could be adequately maintained, then cardiac arrest victims could be sustained for extended periods of time. Occasional reports of extended CPR efforts (45 to 90 minutes) have been reported, with the victims eventually being saved by coronary bypass surgery. See Tovar, et al., *Successful Myocardial Revascularization and Neurologic Recovery,* 22 Texas Heart J. 271 (1995).

In efforts to provide better blood flow and increase the effectiveness of bystander resuscitation efforts, various mechanical devices have been proposed for performing CPR. In one variation of such devices, a belt is placed around the patient's chest and the belt is used to effect chest compressions. Our own patents, Mollenauer et al., *Resuscitation device having a motor driven belt to constrict/compress the chest*, U.S. Pat. No. 6,142,962 (Nov. 7, 2000); Sherman, et al., *CPR Assist Device with Pressure Bladder Feedback, U.S. Pat. No.* 6,616,620 (Sep. 9, 2003); Sherman et al., *Modular CPR assist device*, U.S. Pat. No. 6,066,106 (May 23, 2000); and Sherman et al., Modular CPR assist device, U.S. Pat. No. 6,398,745 (Jun. 4, 2002), and our application Ser. No. 09/866,377 filed on May 25, 2001, show chest compression devices that compress a patient's chest with a belt. Each of these patents is hereby incorporated by reference in their entirety.

Since seconds count during an emergency, any CPR device should be easy to use and facilitate rapid deployment of the device on the patient. Our own devices are easy to deploy quickly and do increase the patient's chances of survival. Nevertheless, a novel compression belt cartridge has been designed to facilitate deployment, use and maintenance of chest compression devices.

SUMMARY

The devices and methods shown below provide for a belt cartridge for use in devices that perform chest compressions.

The cartridge has a belt, a compression pad attached to the belt, a cover plate through which the belt is threaded, a belt spline for attaching the belt to a drive spool of a belt drive platform, and belt guards rotatably attached to the cover plate. During use, the cover plate and belt guards are removably attached to the housing of the belt drive platform. In turn, the belt extends out of the housing and is secured around the patient.

The belt itself is a single band of material that has a non-uniform width. The belt has two portions, with each portion of the belt having shared pull-straps that are narrow, a load distribution section that is wide and a trapezoid-shaped transition section between the pull straps and load distribution sections. The transition sections of the belt are provided with reinforcing plates that strengthen the belt. The load distribution sections of the belt are provided with hook and loop fasteners so that the belt can be secured around the patient. In addition, a peg in the center of one load distribution section fits into a corresponding eyelet in the other load distribution section, thereby providing a means for registering the belt with the center of the patient's sternum. The compression pad is disposed beneath the load distribution sections and facilitates chest compressions.

The cover plate is provided with curved extensions such that the belt cartridge fits within only selected belt drive platforms. The cover plate is also provided with snap latches and hooks so that the cover plate attaches securely to the belt drive platform in a pre-determined orientation. Crossbars and reinforcing beams are provided to the cover plate so that the cover plate may be made from a thin, lightweight plate of plastic. The entire chest compression cartridge is low cost, lightweight and disposable.

DETAILED DESCRIPTION OF THE INVENTIONS

Figure 1:
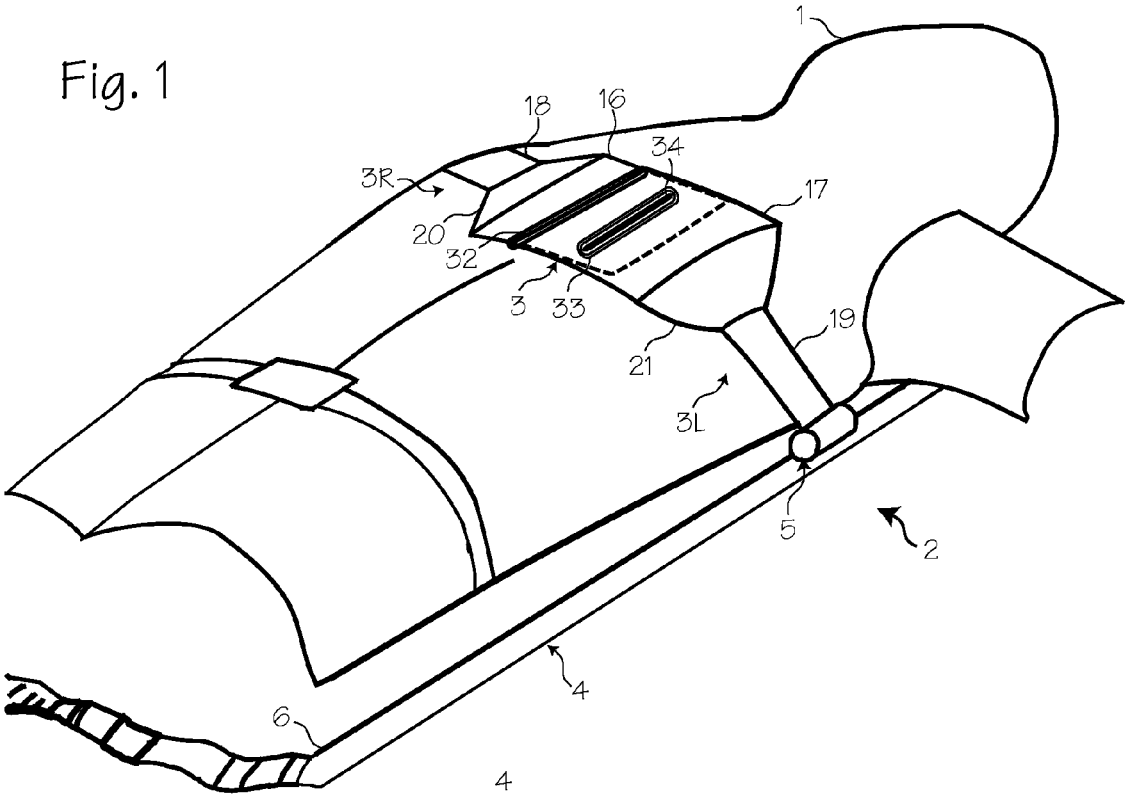
FIG. 1 shows the chest compression belt fitted on a patient.

FIG. 1 shows the chest compression belt fitted on a patient 1. A chest compression device 2 applies compressions with the belt 3, which has a right belt portion 3R and a left belt portion 3L. The chest compression device 2 includes a belt drive platform 4 and a compression belt cartridge 5 (which includes the belt). The belt drive platform includes a housing 6 upon which the patient rests, a means for tightening the belt, a processor and a user interface disposed on the housing. The means for tightening the belt includes a motor, a drive train (clutch, brake and/or gear box) and a drive spool upon which the belt spools during use. Various other mechanisms may be used to tighten the belt, including the mechanisms shown in Lach et al., *Resuscitation Method and Apparatus*, U.S. Pat. No. 4,774,160 (Sep. 13, 1988) and in Kelly et al., *Chest Compression Apparatus for Cardiac Arrest*, U.S. Pat. No.

5,738,637 (Apr. 14, 1998). The entirety of these patents is hereby incorporated by reference.

In use, the patient is placed on the housing and the belt is placed under the patient's axilla (armpits), wrapped around the patient's chest, and secured. The means for tightening the belt then tightens the belt repetitively to perform chest compressions.

The compression belt 3 shown in FIG. 1 is provided with a structure that aids in performing compressions effectively and efficiently. Specifically, the belt is shaped like a double-bladed oar. The wider load distribution sections 16 and 17 of the belt are secured to each other over the patient's chest and apply the bulk of the compressive load during use. The narrow pull straps 18 and 19 of the belt are spooled onto the drive spool of the belt drive platform to tighten the belt during use. The trapezoid-shaped transition sections 20 and 21 reinforce the belt and transfer force from the pull straps to the load distribution sections evenly across the width of the load distribution sections. The narrow end of a trapezoid faces the pull strap and the wide end of a trapezoid faces a corresponding load distribution section.

The pull straps 18 and 19 of the belt are narrow so that the chest compression device may perform compressions more efficiently, thus saving battery power and prolonging the ability of the device to perform compressions. The narrow pull straps of the belt reduce the mass of the belt and reduce the torque necessary to tighten the belt around the patient's chest, particularly when the means for tightening the belt tightens the belt by spooling it around a drive spool. In addition, by using narrow pull straps, the belt may fit within a narrow channel beam in the belt drive platform. This reduces the weight and size of the belt drive platform and increases the strength of the platform by allowing a narrower channel beam (see item 45 of FIG. 2) to be used with the platform.

The load distribution sections 16 and 17 of the belt are wider than the pull straps to allow the chest compression device to perform compressions more effectively and more safely. The wider portions of the belt compress more of the chest, increasing blood flow and thus performing compressions more effectively. In addition, the wider portions of the belt allow more force to be applied to the patient by evenly distributing pressure on the patient's chest, thus increasing blood flow while making chest compressions safer for the patient.

The transition sections 20 and 21 of the belt transfer the tension from the pull straps to the load distribution sections and reinforce the belt. Thus, the transition sections narrow along the lateral portion of the belt.

The right load distribution section 16 and left load distribution section 17 of the belt are provided with hook and loop fasteners so that the belt may be secured to the patient's chest. (Securing the right and left load distribution sections to each other secures the belt around the patient's chest.) Preferably, the hook side of the hook and loop fastener is located on the anterior load distribution section of the belt (in this illustration, the left side is anterior to and superficial to the right load distribution section) so that the hooks do not contact carpet or other materials when the belt is open and splayed on the ground, though the hook and loop fasteners may be located anywhere on the load distribution sections of the belt. A handle 32 (more clearly shown in FIG. 2) is provided on the left end of the belt to aid in placing and removing the belt. The handle and user interface are located on the same side of the belt drive platform to make applying and removing the belt an ergonomic motion.

An eyelet 33 is provided in the left load distribution section of the belt and a corresponding registration peg 34 is provided in the right load distribution section of the belt. (The peg, eyelet and hook and loop fasteners may be disposed on either load distribution section.) To secure the belt to the patient, the left load distribution section is laid over the right load distribution section and the eyelet is aligned with the peg. (The peg fits within the eyelet.) The eyelet and peg assist the rescuer to properly register the load distribution sections with respect to each other and the patient, and thereby properly position the belt on the patient. The eyelet and peg are also long relative to the superior/inferior direction of the patient and are located in the center of the assembled load distribution sections. Thus, the eyelet and peg help the rescuer place the center of the load distribution sections over the center of the patient's sternum. In addition, since the right and left load distribution sections tend to pull away from each other when the belt is tensioned, the peg and eyelet further secure the load distribution sections of the belt to each other by resisting shear forces that tend to pull the sections apart.

In addition, the peg and eyelet enable the rescuer to repeatably release the belt and then secure the belt around the patient such that the belt has the same length each time the belt is secured around the patient. (During use the rescuer may need to release the belt and re-secure the belt around the patient without replacing the cartridge.) Since the belt maintains the same length, the chest compression device is much more likely to achieve the same depth of chest compressions after the belt has been re-secured as compared to before the belt has been re-secured.

The combination of hook and loop fasteners and the eyelet/peg fastener provides for a means for securing the belt around the patient. The same combination allows a rescuer to rapidly and easily release the belt. The rescuer may release the belt, even during compressions, by grasping the left end of the belt and lifting the left load distribution section from the right load distribution section. Thus, the securing mechanism is also an emergency release mechanism. To further enhance safety, the eyelet may be provided with an electrical contact switch, optical sensor or other electrical or mechanical means for determining whether the peg is inserted into the eyelet. Thus, a chest compression device with the appropriate software or hardware can sense whether the peg is fully inserted into the eyelet. If the peg is not in the eyelet, then the chest compression device will not perform compressions. The system will alert the operator if proper registration is not detected so that the operator may re-fit the belt.

Figure 2:
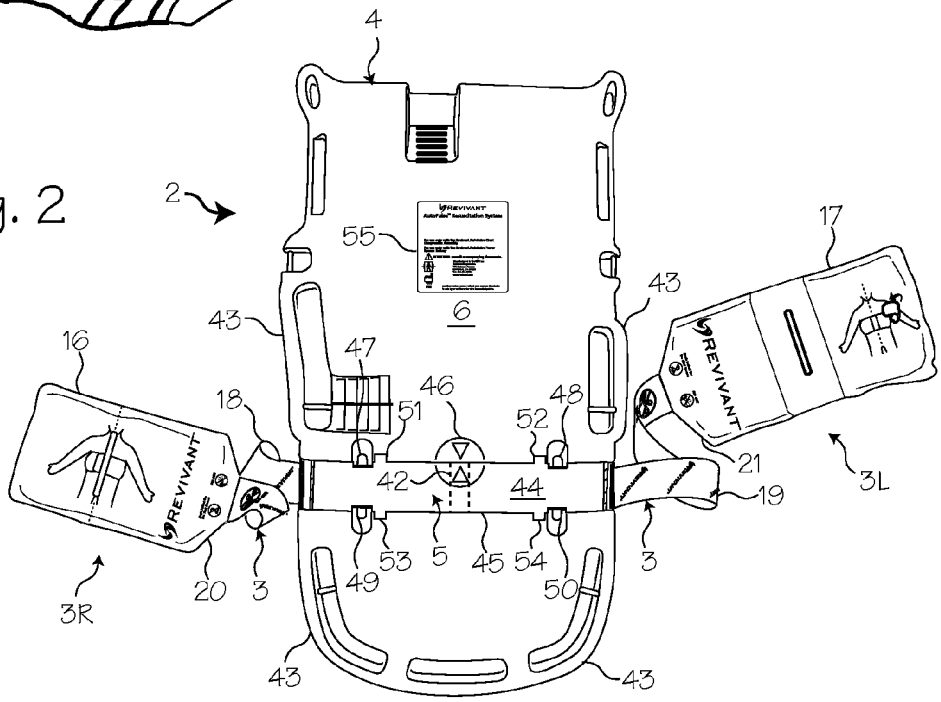
FIG. 2 shows a bottom view of a chest compression device that uses a belt to perform compressions.

FIG. 2 shows a bottom view of the belt drive platform 4 and shows the housing 6, a belt cartridge 5 attached to the housing and a means for tightening the belt disposed within the belt drive platform. The means for tightening the belt may comprise a drive spool 42 attached to the belt and to a motor.

The drive spool is shown in phantom to indicate its position beneath the cover plate. The motor and associated components are located within the belt drive platform.

The belt drive platform is provided with a control system that controls how the belt is wrapped around the drive spool. For example, the drive spool is controlled so that some of the belt is left wrapped around the drive spool between compressions. When the means for tightening has loosened the belt around the patient, just before beginning the next compression, a length of the belt corresponding to one revolution of the drive spool is left wrapped around the drive spool. Thus, the belt will maintain its curled shape, reducing the chance of causing folds in the belt during compressions and increasing the efficiency of spooling the belt around the drive spool.

The housing serves as a support for the patient. Handles 43 provide for easy transport of the housing and of the patient while on the housing. The belt cartridge has a cover plate 44 that fits within a channel beam 45 in the belt drive platform, thus securing the belt cartridge 41 to the belt drive platform 4. Labels 46 are placed on the housing and cover plate to indicate the proper alignment of the cover plate. The cover plate is secured to and aligned within the channel beam by the use of retainer clips or snap latches 47, 48, 49 and 50 which fit between corresponding paired bosses or detents in the housing. Tabs integrally formed with the snap latches extend into slots disposed in the housing of the belt drive platform. The cover plate is also aligned and secured within the channel beam by the use of hooks 51, 52, 53 and 54 which fit into corresponding apertures in the housing. In addition, the cover plate is also provided with additional labeling 55 to provide warnings, manufacturer information, trademarks or advertising.

Figure 3:
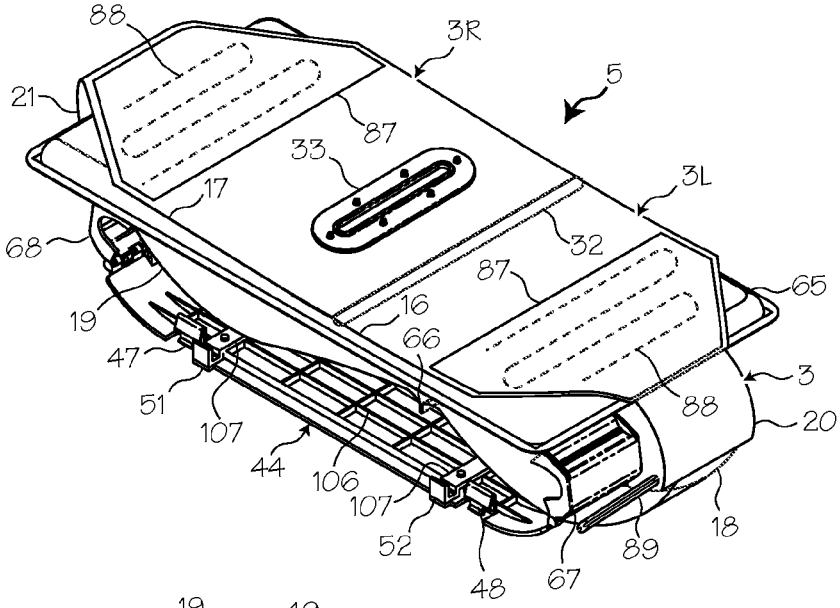
FIG. 3 shows a top (anterior) view of a belt cartridge used with a belt drive platform.
Figure 4:
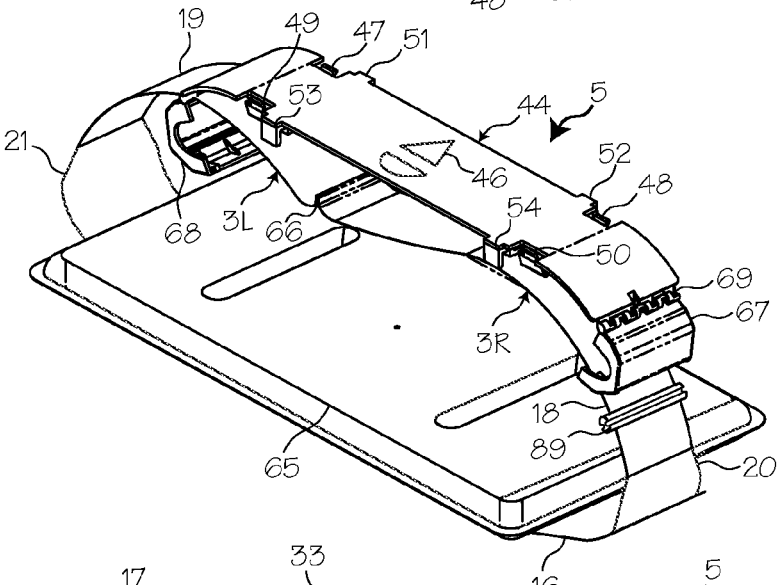
FIG. 4 shows a bottom (posterior) view of a belt cartridge used with the belt drive platform.
Figure 5:
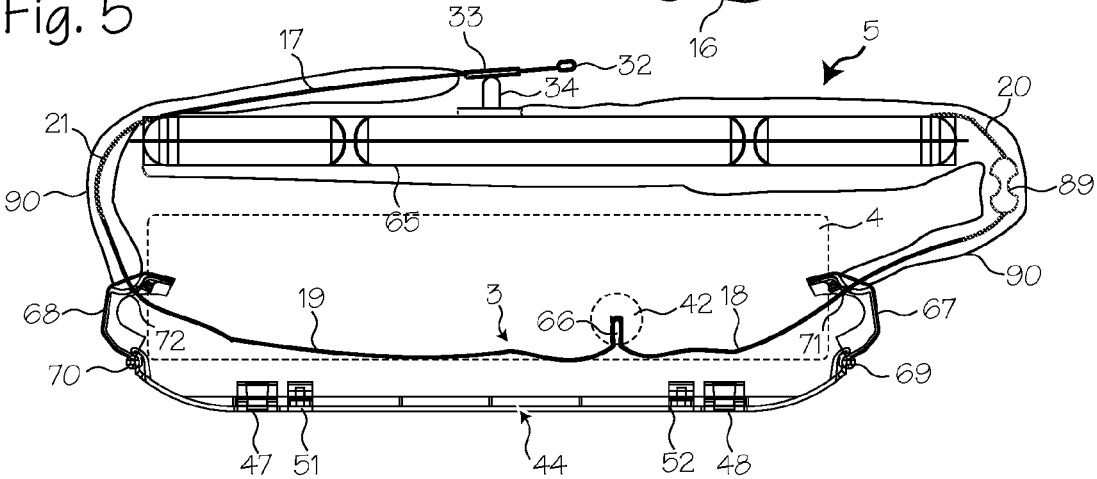
FIG. 5 shows a superior view of a belt cartridge used with the belt drive platform.

FIGS. 3, 4 and 5 show the belt cartridge 41. The belt cartridge is disposable so that there is no need to clean the belt, or other elements of the cartridge, after use. Thus, the belt cartridge reduces the exposure of subsequent patients and users to bodily fluids or other contaminants. If necessary, the cartridge may be replaced while the patient is still on the belt drive platform. In addition, since the belt cartridge is disposable the belt may be made of materials that readily conform to the shape of an individual patient, but have a shorter service life.

The cartridge includes a belt 3, a compression pad 65 attached to the belt, a belt clip, key or spline 66 for attaching the belt to a drive spool, a cover plate 44 and belt guards 67 and 68 rotatably attached to the cover plate via hinges 69 and 70. The belt guards are removably secured over spindles that are attached to the belt drive platform. A liner, sleeve or sock is disposed over the belt, as shown in FIG. 5. The belt is threaded through slots 71 and 72 disposed in the belt guards 67 and 68. With regard to the belt 3, the right portion 3R and the left portion 3L of the belt share pull straps 18 and 19 and each have a load distribution section 16 and 17 and a transition section 20 and 21. Each load distribution section of the belt is provided with hook and loop fasteners so that the belt may be secured around the patient's chest. Additionally, as described above, an eyelet 33 is provided in the left load distribution section and a corresponding peg 34 is provided in the right load distribution section (see FIG. 5). Preferably, the pull strap sections comprise a single strap.

The pull straps of the belt are secured to the drive spool of the belt drive platform with the spline 66, which is attached to the pull straps of the belt. The spline fits within a slot provided in the drive spool. When the drive spool rotates, the pull straps spool around the drive spool. The compression belt then tightens and is pulled onto the patient's chest, thereby accomplishing compressions.

The pull straps 18 and 19 of the belt are threaded through the belt guards 67 and 68 which are rotatably attached to the cover plate 44. The belt guards and cover plate are fashioned from a lightweight but strong plastic. The cover plate and belt guards are designed to allow the belt cartridge to be removably attached to the belt drive platform and to protect the belt during use. Specifically, the cover plate is provided with snap latches 47, 48, 49 and 50 that fit between corresponding paired bosses or detents on the housing. Integral tabs extend from the snap latches and fit into corresponding slots in the housing. The cover plate is also provided with hooks 51, 52, 53 and 54 that fit into corresponding apertures in the housing of the belt drive platform. The snap latches and hooks are designed so that the cover plate is removably attached to the belt drive platform without the use of tools. The snap latches and hooks may have a variety of shapes and forms. The snap latches and hooks may also be asymmetrical with respect to the cover plate, thus making it possible to fit the cover plate on the belt drive platform in only one orientation. To increase the ease of use of the cartridge, the cover plate is provided with labels 46 to indicate the desired orientation of the cover plate with respect to the belt drive platform.

Below the load distribution sections of the belt is a compression pad 65 that affects the distribution of compression force and assists in performing chest compressions. An example of a chest compression pad may be found in our application Ser. No. 10/192,771, filed Jul. 10, 2002. In one embodiment the compression pad is a three-sectioned bladder filled with foam. The compression pad is located on the belt so that it is centered over the patient's chest when the belt is in use. The compression pad is disposed below the load distribution sections of the belt and is removably attached to the belt with double-stick tape, hook and loop fasteners or comparable fastening means. The compression pad is also disposed inside the liner sock.

Additional safety features may be provided with the compression belt cartridge 41. For example, spreader bars or reinforcing plates 87 may be attached to the transition sections of the belt with stitches 88. (The reinforcing plates may be attached to the transition sections of the belt by any suitable method.) The reinforcing plates reinforce the transition sections of the belt and help prevent the transition and load distribution sections from twisting, bending, folding or otherwise deforming with respect to the pull straps, except in regard to the ability of the belt to wrap around the patient's chest. The reinforcing plates are made of a hard plastic or other non-resilient, though flexible material.

The belt also may be provided with one or more breakable couplings or breakable links 89 on one or both sides of the load distribution or belt transition sections. The breakable link 89 or links are interposed between sequential portions of the belt such that the belt separates if a link breaks. The link is designed to break at a predetermined tension. If the belt experiences an unsafe amount of tension, then a link breaks, the belt separates and the patient is thereby protected from excessive forces. What constitutes an unsafe amount of tension or excessive force varies, depending on the patient and the device and belt used, but is in the range of about 200 pounds to about 500 pounds as measured in the area of the belt to the side of the patient. Preferably, the link is designed to break under about 300 pounds of tension as measured in the area of the belt to the side of the patient. In addition, the link may be designed to reattach to itself or to a clip or other mating fastener after failure. Thus, in the event of link failure, the belt may be re-attached quickly and compressions may be restarted with minimal delay.

To prevent the load distribution sections from twisting relative to the other sections of the belt, the links may be designed to also serve as swivel joints, or the belt may be provided with additional swivel joints along the belt. The swivel joints connect the pull straps to the belt transition sections. The swivel joints allow the load distribution sections to twist relative to the pull straps, about the longitudinal axis of the belt, without twisting the pull straps themselves.

Another safety feature is a liner sock 90 for the belt (see FIG. 5). The liner sock surrounds the portions of the pull straps, as well as the compression pad, that contact the patient thereby protecting the patient from friction as the belt moves during compressions. The liner socks are attached to the belt guards around the belt guard slots so that hair, other body parts or other foreign objects cannot become caught in the belt guard slots. On the other end, the socks are disposed around and are attached to the load distribution sections of the belt.

In use, the belt spline is inserted into the drive spool of the belt drive platform. The cover plate of the cartridge is then inserted into the channel beam of the belt drive platform and fixed into place via the hooks and snap latches. The belt is wrapped around the patient, with the load distribution sections secured over the patient's chest. Thus, the chest compression device performs compressions by repetitively tightening the belt.

Figure 6:
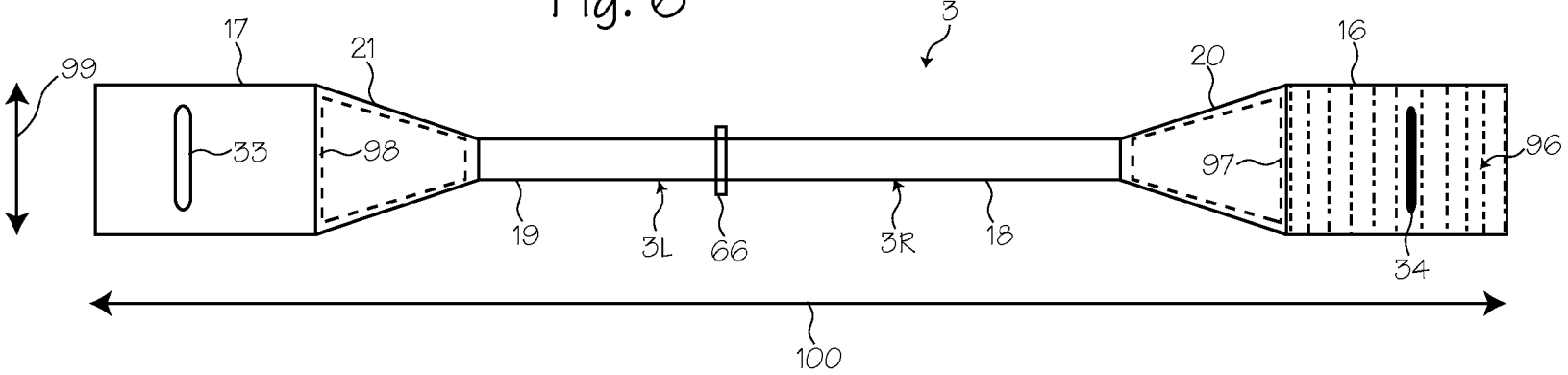
FIG. 6 shows the belt used in the belt cartridge of FIGS. 3 through 5.

FIG. 6 shows the belt 3 used in the belt cartridge of FIGS. 3 through 5. When laid out, the belt has the shape of a double-sided oar or paddle. As described above in reference to FIGS. 3 through 5, the right portion 3R and the left portion 3L of the belt each have a load distribution section 16 and 17, a transition section 20 and 21 and pull straps 18 and 19. The pull straps are narrow with respect to the load distribution sections. The load distribution sections are disposed opposite each other, and each load distribution section of the belt is provided with hook and loop fasteners 96 so that the belt may be secured to the patient's chest. An eyelet 33 is provided in the left load distribution section and a corresponding peg 34 is provided in the right load distribution section to further secure the belt around the patient. (The peg and eyelet may comprise a variety of shapes and sizes; for example, the peg may be a post and the eyelet a round grommet.) In addition, a spline 66 is attached to the belt by any suitable manner. The spline fits within a slot provided in the drive spool of the belt drive platform. Thus, when the drive spool rotates, the pull straps will spool around the drive spool.

The transition sections 20 and 21 of the belt are disposed opposite each other and are provided with corresponding thin (1/16 inch) reinforcing plates 97 and 98 of flexible plastic that reinforce the belt. (The plates may comprise different materials and may be thicker or thinner, or even of varying thickness, depending on the material used and the desired stiffness of the transition sections; however, plates with a thickness of about ¼ inch or less are preferred.) The reinforcing plates mitigate the effects of stress concentrations in the belt, stress voids in the belt, belt creasing, belt wadding and other problems caused by using a compression belt that has a non-uniform width. The reinforcing plates are attached to the transition sections of the belt and the shape of the reinforcing plates conforms to the shape of the transition sections of the belt. (The reinforcing plates may be attached to the transition sections by any suitable means and may be located above, below or within the transition sections.) The reinforcing plates also bend to conform to the shape of the patient's torso during compressions. As the plates bend around the patient, the bending stiffness of the plates along the other axes of the plates increases. To provide smooth compressions along the patient's chest, one or more edges of the reinforcing plates may be bent outwards and away from the patient (like ski tips).

The belt material of the pull straps, the load distribution sections and the transition sections has a constant thickness of about 0.010 inches and is made of a custom, fiber-reinforced material that can be manufactured by a number of belt manufacturers. Our belt is a material made from unidirectional layers of high-strength fibers held together with a resin. (The fibers are Spectra 2000 fibers available from Allied Signall, Inc., but may also be carbon, Kevlar™ and other fibers.) Our custom belts do not stretch or break under heavy loads, and are resistant to bodily fluids, aging, humidity and temperature.

The belt may also be made of a flat metal or rounded metallic cable, nylon, sail cloth or other strong and flexible materials. The belt material may also include layers of additional materials such as Tyvek™ (high-density, spun bonded polyethylene) or Teflon™ (polytetrafluoroethylene) directly bonded to the primary belt material.

The custom belts used with the belt cartridge have 4 laminated layers of fibers oriented at 0, 90, 6 and −6 degree angles with respect to the long axis of the belt. Placing at least some of the layers obliquely with respect to the long axis of the belt improves belt performance and longevity. The resin holding the fibers together is about 60% to 70% of the volume of the material. An additional layer is laminated on the outside of the belt to improve water resistance and lessen friction during use. A belt designed with laminated fibers at different orientations with respect to the long axis of the belt is less likely to stretch during compressions. The above belt has an average stiffness of about 77,000 pounds per inch per one-inch length of belt, as measured along the longitudinal axis of the belt, and thus does not stretch during compressions.

The belt (or cable) may be pre-conditioned before distribution or sale. The cartridge and belt may be disposed on a test platform and the cartridge and belt tested before being sold. This process pre-conditions the belt. Pre-conditioning the belt deforms the belt to the shape of the spool shaft, which allows for more efficient spooling of the belt during compressions. Preconditioning also helps prevent the belt from deforming during use. Thus, preconditioned belts will perform consistently during use. In addition, the belt is at least partially spooled around the drive spool during storage so that the pull straps are set to the shape of the drive spool prior to use.

The overall belt and belt cartridge are sized and dimensioned to be used with 95% of all body sizes. (Only extremely small or large patients may have difficulty benefiting from a device that includes the compression belt cartridge.) The pull straps are about 2 inches wide (along the superior-inferior dimension of the patient, as indicated by the direction of arrows 99) and about 40 inches long (along the medial-lateral dimension of the patient, as indicated by the direction of arrows 100). The load distribution sections of the belt are about 8 inches wide and about 12 inches long. The transition sections of the belt are about 6 inches long and taper gradually between the pull straps and a load distribution section; thus, the transition sections have a trapezoidal shape. All sections of the belt material have a constant thickness of about 0.010 inches, with a tolerance of 0.001 inches. The belt may be thinner to reduce the weight of the cartridge and the overall device, though the belt may be as thick as 0.25 inches.

Because the belt is thin, the overall weight of a compression device is kept to a minimum. Using a thin belt also spools less material onto a drive spool during use. This reduces the overall diameter of the drive spool plus belt material, thereby reducing the amount of torque necessary to operate the chest compression device. Thus, using a thin belt also saves energy, thereby increasing the life of a battery used to power a chest compression device.

Figure 7:
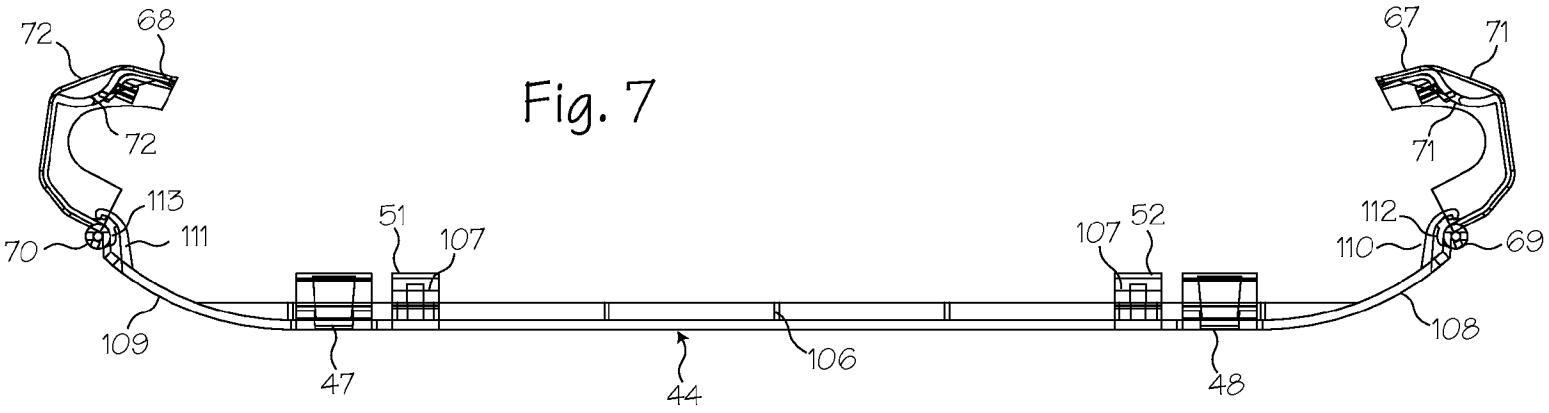
FIG. 7 shows a close-up view of the cover plate used in the belt cartridge of FIGS. 3 through 5.

FIG. 7 shows a close-up view of the cover plate 44 used in the belt cartridge of FIGS. 3 through 5. As already described, the cover plate is designed to allow the belt cartridge to be removably attached to the belt drive platform and to protect the belt during use. Specifically, the cover plate is provided with hooks 51 and 52 that fit within apertures provided in the housing. The cover plate is also provided with snap latches 47 and 48 which fit securely between corresponding paired bosses or detents that extend from slots disposed in the housing. Tabs integrally formed with the snap latches extend into the slots when the cover plate is secured to the housing.

To reduce weight, the cover plate is fashioned from a thin plate of plastic. To increase strength, the cover plate is provided with intersecting reinforcing ribs 106 (also shown in FIG. 3) that reinforce the cover plate and help the cover plate to resist the force of compressions. Additional aluminum reinforcement braces 107 (also shown in FIG. 3) are provided to further reinforce the cover plate. The reinforcement braces span the height of the cover plate to provide the cover plate with additional strength. The reinforcement braces also brace the channel beam, thereby protecting the belt drive platform from deforming under high forces.

The cover plate is provided with opposing curved extensions 108 and 109 so that the cover plate fits precisely within the belt drive platform. The curved extensions, as well as the overall size and dimensions of the cover plate, prevent the belt cartridge from being used with devices not designed to receive the belt cartridge. Thus, the cover plate also helps ensure that the cartridge will be used safely.

Rotatably attached to the curved extensions of the cover plate are belt guards 67 and 68 that protect the user, belt drive platform and belt when the chest compression device is in use. The belt guards are removably secured around the spindles during use. The belt guards are wider than the belt, and the pull straps are threaded through slots 71 and 72 disposed in the belt guards. Thus, during use, the belt slides within the belt guards and over the spindles. The spindles, in turn, rotate within the belt drive platform. The spindles also rotate underneath the belt guards, sliding against the belt guards where the belt guards are disposed against the spindles.

On each end of the cover plate, fingers or pawls 110 and 111 hook around corresponding catches or ratchets 112 and 113. The ratchets are attached to corresponding hinges 69 and 70, though may be attached to the corresponding belt guards. The pawls are attached to the cover plate and prevent the belt guards from curling away from the cover plate. However, a user may (preferably without tools) apply a force sufficient to pull the ratchets away from the pawls as the hinges rotate, thereby allowing belt guards more freedom to rotate outwardly, away from the cover plate. The user may also re-engage the pawl and ratchet so that the belt guards are once again prevented from curling outwardly.

The various components of the belt cartridge may be differently oriented with respect to each other. For example, the compression pad may be disposed beneath the liner sock instead of inside the liner sock. In other embodiments, if the geometry of the belt drive platform changes, then the compression belt cartridge may be changed accordingly. For example, if the drive spool is located to one side of the belt drive platform, then the spline would be located outside the belt guards (instead of between them) and the rest of the cartridge would be adjusted to fit to the housing and belt drive platform. The belt may have other shapes; for example, the belt may have more than one narrow region. (If the belt drive platform uses more than one drive spool then the belt may have more than one set of pull straps.) In addition, other means for tightening the belt may be used, such as multiple motors and drive spools, pistons, scissors mechanisms or other mechanical actuators.

While the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. A system for performing chest compressions on a patient, said system comprising:

a compression belt cartridge comprising:

a laminated belt having at least four layers of unidirectional fibers held together with a resin and first and second load distribution sections and a pull strap section, the first and second load distribution sections having a width corresponding to the superior-inferior height of the patient when the laminated belt is disposed around the patient, the laminated belt also having a length corresponding to the medial-lateral circumference of the patient when the laminated belt is disposed around the patient, the first load distribution section attached to a first end of the pull strap section, and the second load distribution section attached to a second end of the pull strap section;

a first transition section attached between the first load distribution section and the pull strap section;

a first spreader bar secured to the first transition section;

a second transition section attached between the second load distribution section and the pull strap section;

a second spreader bar secured to the second transition section;

a cover plate; and a belt drive platform having a means for tightening the laminated belt disposed within the belt drive platform, the cover plate is removably attachable to the belt drive platform, and the laminated belt is operably attachable to the means for tightening.

2. A method of performing chest compressions on a patient, said method comprising the steps of:

providing a system for performing chest compressions on a patient, said system comprising:

a housing suitable for supporting the patient during compressions;

a compression belt cartridge comprising:

a laminated belt having first and second load distribution sections and a pull strap section, the first and second load distribution sections having a width corresponding to the superior-inferior height of the patient when the laminated belt is disposed around the patient, the laminated belt also having a length corresponding to the medial-lateral circumference of the patient when the laminated belt is disposed around the patient, the first load distribution section attached to a first end of the pull strap section, and the second load distribution section attached to a second end of the pull strap section;

a first transition section attached between the first load distribution section and the pull strap section;

a second transition section attached between the second load distribution section and the pull strap section;

a first spreader bar attached to the first transition section and a second spreader bar attached to the second transition section;

a cover plate removably attachable to the housing;

a compression pad attached to the first load distribution section;

hook and loop fasteners disposed on the first and second load distribution sections such that the first and second load distribution sections may be secured to each other over the chest of the patient;

an eyelet attached to the first load distribution section and a peg attached to the second load distribution section, wherein the eyelet is sized and dimensioned to receive the peg and wherein the peg may be inserted into the eyelet when the first and second load distribution sections are secured over the chest of the patient;

a means for tightening the laminated belt operably connected to and disposed within the housing, wherein the pull strap section is removably attachable to the means for tightening the belt;

placing the patient on the housing;

attaching the load distribution sections of the laminated belt to each other and placing the load distribution sections over the chest of the patient; and sequentially tightening and loosening the laminated belt to sequentially compress and expand the chest of the patient and retaining at least one revolution of the laminated belt on the means for tightening.

* * * * *